US006262352B1

(12) United States Patent
Liu

(10) Patent No.: US 6,262,352 B1
(45) Date of Patent: Jul. 17, 2001

(54) CONTROLLING DEVICE OF MUSIC BELL IN THE PEARL BOX

(76) Inventor: Jack Liu, No. 3, Alley 202, Kao-Fon Road, Hsin-Chu City (TW)

( * ) Notice: Subject to any disclaimer, the term of this patent is extended or adjusted under 35 U.S.C. 154(b) by 0 days.

(21) Appl. No.: 09/425,954

(22) Filed: Oct. 25, 1999

(30) Foreign Application Priority Data

Oct. 29, 1998 (TW) ..... 87217894

(51) Int. Cl.[7] ..... G10F 1/06

(52) U.S. Cl. ..... 84/95.2; 84/95.1; 84/94.1; 84/94.2; 446/311; 446/309; 446/310

(58) Field of Search ..... 84/94.1, 94.2, 84/95.1, 95.2; 446/311, 309, 310

(56) References Cited

U.S. PATENT DOCUMENTS 2,807,118 * 9/1957 Reuge ..... 446/303
4,407,504 * 10/1983 Popov ..... 273/153 R
5,345,153 * 9/1994 Vaught ..... 318/4
5,424,485 * 6/1995 Hsu et al. ..... 84/95.1

* cited by examiner

*Primary Examiner*—Shih-Yung Hsieh
(74) *Attorney, Agent, or Firm*—Rabin & Champagne, P.C.

(57) ABSTRACT

A music bell controlling device of a pearl box comprises a controlling device, a rotary shaft, and a gear set, etc. The gear set is installed between the bottom and base of the music bell. An elastomer is installed at the upper end of the longitudinal axis of the rotary shaft; a base end of the rotary shaft passes through the through hole to combine with the gear set. The upper end of the rotary axis is swingable. The longitudinal axis of the rotary shaft passes through the controlling device; and swinging of the rotary shaft will drive the controlling device to shift so that the controlling device confines the rotation of the music bell flywheel. As the upper cover of the pearl box is closed, the upper cover will drive the rotary axis to shift to a predetermined direction so that the swingable rod of the control device will shift. Thus, the swingable rod contact with the flywheel of music box, and thus, the music bell stops.

8 Claims, 3 Drawing Sheets

CONTROLLING DEVICE OF MUSIC BELL IN THE PEARL BOX

BACKGROUND OF THE INVENTION

1. Field of the Invention

The present invention relates to music bell controlling device, and especially to a controlling device for controlling the music bell as a cover is open or closed.

2. Description of the Prior Art

As shown in FIG. 7, a prior art music bell controlling device is illustrated. A longitudinal rotary shaft D supported by a supporter E is installed above the roller of a music bell B. The rotary shaft D can be driven by the roller to rotate, and a controlling device F is installed. As the upper cover of the pearl box covers, the upper cover will drive the rotary shaft D to shift to the predetermined direction. The shifting of the rotary shaft will drive the controlling device to rotate so that the distal end of the controlling device F will contact with the flywheel of the music bell. Thus, the operation of the music bell B is stopped, as shown in FIG. 8.

However, in the aforesaid prior art structure, since the rotary shaft and the controlling device are above the music bell, a sufficient distance must be maintained between the spacer of the pearl box and the music bell for arranging aforesaid rotary shaft and the controlling device. Namely, the whole height of the pearl box can not be reduced effectively. Therefore, the whole outlook of the pearl box is not beautiful.

Furthermore, according to the aforesaid rotary shaft and the controlling device, a sufficient large shifting force is required for the rotary shaft to drive the distal end of the controlling device to contact with the flywheel of the music bell. Namely, a sufficient long hole is necessary to be remained in the spacer for providing a shifting space for the upper end of the rotary shaft. Such a large hole will have a bad effect to the outlook of the pearl box.

SUMMARY OF THE INVENTION

Accordingly, the primary object of the present invention is to provide a music bell controlling device of a pearl box comprising a controlling device, a rotary shaft, and a gear set, etc. The rotary shaft can be driven by gear set so as to rotate. The longitudinal axis of the rotary shaft passes through the controlling device. The upper end of the longitudinal axis can be swung in a small extent. A spring is installed at the upper end of the longitudinal axis.

By the aforesaid structure, since the rotary shaft extends upwards from the bottom of the music bell and the controlling device is arranged in the horizontal direction. Therefore, the spacing between the spacer of the pearl box and the music bell can be reduced effectively.

Moreover, only a small shifting of the rotary shaft will cause the controlling device to drive the music bell flywheel to rotate, and the rotary shaft includes a spring. Therefore, only a very small long hole is required to be sustained for providing a shifting space of the upper end of the rotary shaft. Therefore, the outlook of a pearl box is improved greatly.

The present invention will be better understood and its numerous objects and advantages will become apparent to those skilled in the art by referencing to the following drawings in which:

DETAILED DESCRIPTION OF THE PREFERRED EMBODIMENT

The detail of the present invention will be described in the following with reference to the appended figures.

Figure 1:
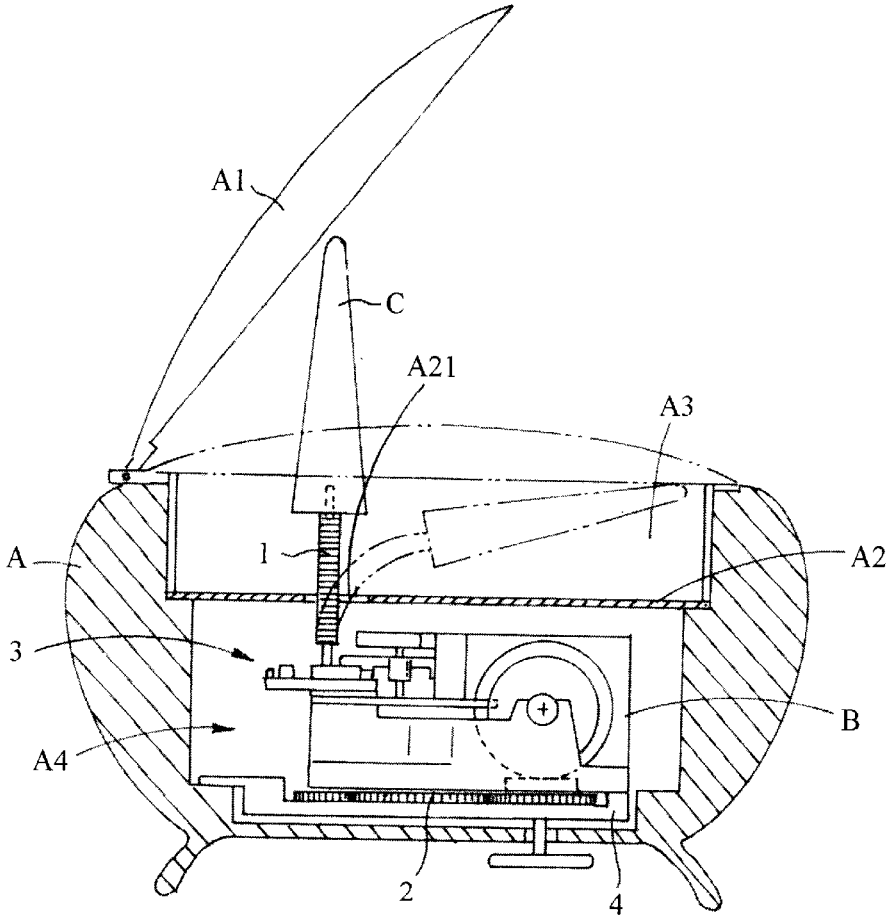
FIG. 1 is a cross sectional view of the present invention.

FIG. 1 shows the pearl box according to the present invention. The pearl box has an upper cover A1, and a spacer rod A2 within the box A for dividing the box into an interior space A4 and an exterior space A3. Moreover, the interior space A4 is arranged with a music bell B the power of which is from a spring; and a rotary shaft 1 longitudinally extending from the music bell B to pass through the opening A21 of the spacer. The distal end of the rotary shaft 1 is installed with a decoration C. A horizontal controlling device 3 is installed at the frame of the music bell B with respect to the rotary shaft 1. At the preset position of the music bell frame is installed with a longitudinal through hole B3.

Figure 2:
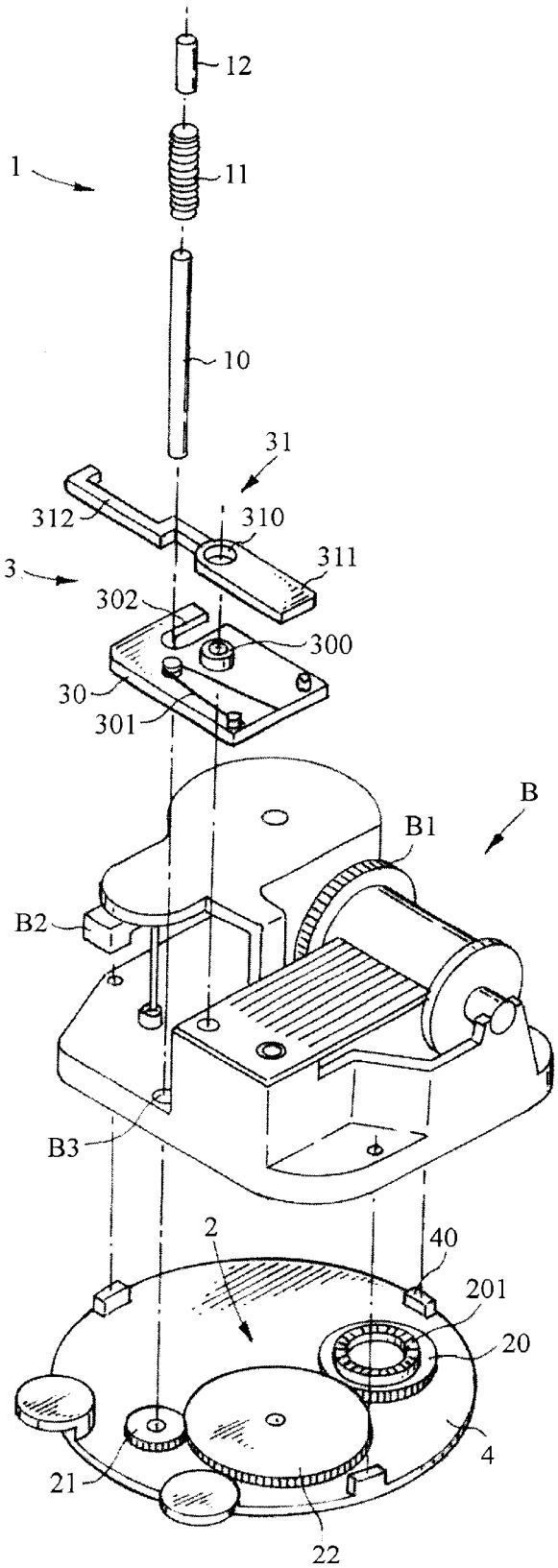
FIG. 2 is a schematic perspective view showing the primary components of the present invention.

Moreover, a base 4 for positioning the music bell B is installed as shown in FIGS. 1 and 2. The base 4 is installed at the bottom of the inner space A4 of the box. Protrusions 40 with respect to the frame of the music bell B are installed at the periphery of the base 4, then the distance between the bottom of the music bell frame and the base 4 is preset.

A gear set 2 is formed between the bottom of the music bell frame and the base 4. The gear set 2 includes at least a pair of transmission gears 20 of the music bell roller teeth B1 and one driving gear 21 with respect to the through hole B3 of the music bell frame. According to practical requirement, a middle gear is installed between the transmission gear 20 and the driving gear 21.

A crown gear 201 is installed at the upper surface of the transmission gear 20 with respect to the music bell roller teeth B1. Then, the rotary power of the music bell roller can be transmitted by the roller teeth B1 and the gear set 2 so that the aforesaid driving gear 21 can be driven to rotate.

Moreover, a longitudinally arranged rotary shaft 1 is installed. The rotary shaft 1 includes a longitudinal axial member 10, a spring 11 and a short rod 12. The base end of the longitudinal axial member 10 passes through the through hole B3 of the music bell frame so as to combine with the driving gear 21 of the gear set 2. Therefore, the aforesaid rotary shaft 1 and the driving gear 21 can rotate synchronously. The aforesaid short rod serves to provide the function of fixing a decoration C.

The diameter of the aforesaid longitudinal axis 10 is set to be smaller than that of the through hole B3, and therefore, the upper end of the rotary shaft 1 is formed as a swingable condition in a preset extension. The swinging extent thereof is not over the range between the driving gear 21 and the middle gear 22.

Moreover, a controlling device 3 is installed at the horizontal position of a music bell flywheel B2. The controlling device 3 includes a fixing plate 30 fixed to the music bell frame and a swinging rod 31 on the fixing plate 30. A groove 302 is installed at the fixing plate 30 with respect to the rotary shaft 1. By the engagement of the hole 310 and the axial center 300 of the fixing plate 30, the swinging rod 31 rotates around the axial center 300.

The base end 311 of the swinging rod 31 is on the fixing plate 30 and is pressed by a spring 301. The distal end 312 of the swinging rod 31 extends to the flywheel B2 of the music bell B.

The distal end 312 of the swinging rod 31 extends in a direction opposite to the groove 302 of the fixing plate. Thus, the rotary shaft 1 passing through the controlling device 3 is supported between the groove 302 and the swinging rod 31, as shown in FIGS. 3 and 4.

Figure 3:
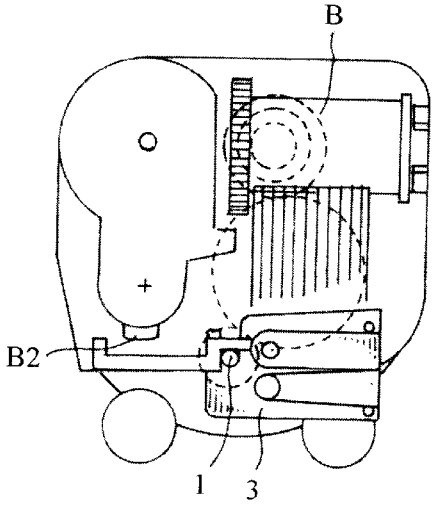
FIG. 3 is an upper view of the present invention.
Figure 4:
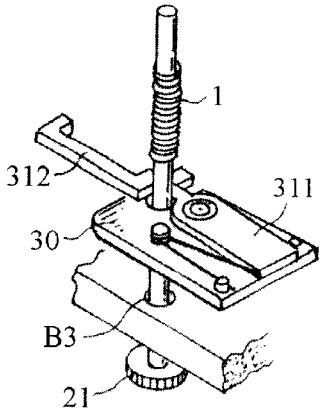
FIG. 4 is a schematic perspective view showing the rotary shaft and the controlling device of the present invention.

By the aforesaid structure, if the upper cover A1 of the pearl box is opened, by the elastic force of the spring 301 on the fixing plate 30, the swinging rod 31 will be sustained in the initial position, as shown in FIG. 3. Then, the distal end 312 of the swinging rod 31 is beyond the rotation range of the music bell flywheel B2. Thus, by the transmission of the gear set 2, the power of the music bell B will drive the decoration C on the rotary shaft to rotate.

Figure 5:
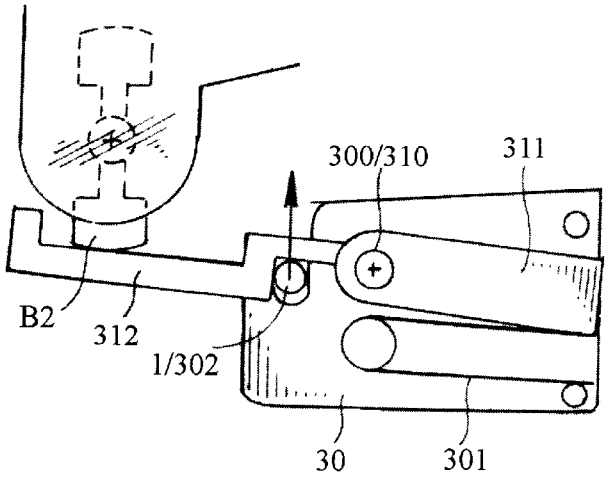
FIG. 5 is an upper view showing the relative position of the controlling device and the music bell after the rotary shaft is driven to shift.
Figure 7:
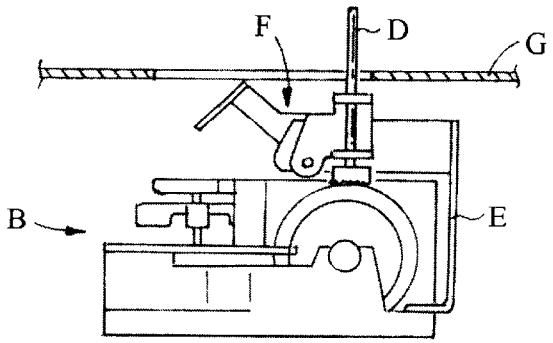
Fig. 7 (Prior Art)
FIG. 7 is a schematic view of the controlling device in the prior art.
Figure 8:
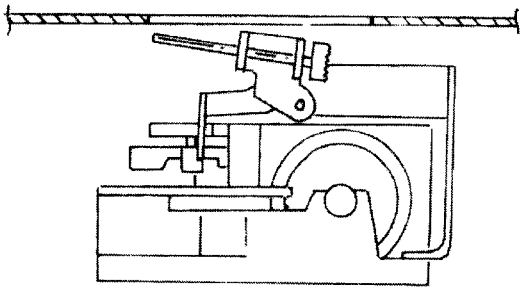
Fig. 8 (Prior Art)
FIG. 8 is a schematic view of FIG. 7, wherein the prior art controlling device is shifted.

If the upper cover A1 of the pearl box is closed, at first, the upper cover A1 will touch and push the decoration C to move toward a predetermined direction. Namely, the upper end of the rotary shaft 1 is pushed to swing. Then, the swinging of the longitudinal axis 10 of the rotary shaft 1 will drive the swinging rod 31 of the controlling device 3 so that the distal end 312 of the swinging rod 31 shifts toward the music bell flywheel B2, as shown in FIG. 5. As a result, the distal end 312 of the swinging rod 31 contacts with the flywheel B2 so that the power of the music bell B is confined and then is stopped.

During the process from the upper cover A1 of the pearl box contacting with the decoration to the distal end 312 of the swinging rod 31 contacting with the flywheel B2 so that the power of the music bell B is confined and then is stopped, the upper cover A1 only moves a small angle, i.e. the upper cover A1 is never closed to a predetermined position. Therefore, the upper cover A1 will push the decoration C continuously, the spring of the rotary shaft 1 starts to bend until the upper cover A1 is closed completely, as the dashed line shown in FIG. 1.

As described above, since the rotary shaft 1 extends upwards from the bottom of the music bell B and the controlling device 3 thereof is arranged in the horizontal orientation. Therefore, the space from the spacer A2 of the pearl box to the music bell B can be reduced effectively.

Moreover, only a small shifting of the rotary shaft 1 will cause the controlling device 3 to confine the rotation of the music bell flywheel B2. The rotary shaft 1 includes a spring 11. Therefore, the aforesaid spacer A2 only needs a very small long opening A21 for providing a shifting space to the upper end of the rotary shaft 1. This small long opening A2 can much improve the visual outlook of the pearl box.

Figure 6:
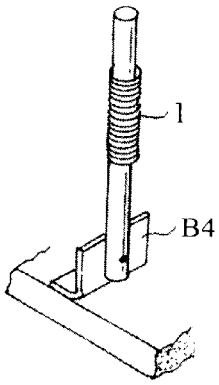
FIG. 6 is a modified embodiment of the base end of the rotary shaft according to the present invention.

In, the above said embodiment, the rotary shaft 1 is driven to rotate, however, in the state that the rotary shaft 1 is unnecessary to be rotated, then the base end of the rotary shaft 1 can be pivotally connected to a predetermined position at the supporter B4 of the music bell frame, as the varied embodiment shown in FIG. 6. The upper end of the rotary shaft 1 can be swung. Therefore, during the process of closing the upper cover A1 of the music bell, the rotary shaft 1 can be driven to rotate such that the controlling device 3 further confines the rotation of the music bell flywheel B2.

Although certain preferred embodiment of the present invention has been shown and described in detail, it should be understood that various changes and modification may be made therein without departing from the scope of the appended claims.

What is claimed is:

1. A music bell controlling arrangement for a music box, comprising:

a music bell having a flywheel, said flywheel rotating when the music bell is activated;

a shaft having an axial member, a flexible spring member attached to one end of said axial member, and a short rod connected to said spring member so that said axial member is connected to said short rod via said spring member, wherein when a force is applied to said short rod, said shaft bends at the spring member, and said axial member is axially displaced; and a controlling device that is activatable by the axial displacement of said axial member, wherein when said controlling device is activated, said controlling device engages said flywheel to stop said flywheel from rotating, thereby deactivating said music bell; and a fixing plate to a frame of said music bell, said fixing plate having a groove formed therein, said axial member passing through the groove;

a swinging rod pivotally connected to said fixing plate, and having a base end disposed on the fixing plate, and a distal end movable to engage with said flywheel when said controlling device is activated.

2. The music bell controlling arrangement of claim 1, wherein said music bell has a through hole therein, said shaft passing through the through hole.

3. The music bell controlling arrangement of claim 2, further comprising a gear set disposed beneath said music bell, and being driven by said music bell, said axial member being connected to a respective gear of said gear set, whereby when said music bell is activated, the respective gear rotates, causing said shaft to axially rotate.

4. The music bell controlling arrangement of claim 2, wherein said music bell includes a frame, the hole being formed in the frame.

5. The music bell controlling arrangement of claim 1, wherein said axial member has a further end pivotally connected to a frame of said music bell.

6. The music bell controlling arrangement of claim 1, wherein said controlling device is horizontally disposed relative to said flywheel.

7. The music bell controlling arrangement of claim 1, wherein said controlling device includes:

a spring connected to said fixing plate and pressing against the base end of said swinging rod, said spring urging the distal end of swinging rod out of engagement with said flywheel when the force is removed against said short rod.

8. The music bell controlling arrangement of claim 7, wherein said axial member is axially displaced within the groove when the force is applied to said short rod.

* * * * *